US012246902B2

(12) United States Patent
McGrath

(10) Patent No.: US 12,246,902 B2
(45) Date of Patent: Mar. 11, 2025

(54) PRODUCT POUCH ARRANGEMENT AND METHOD OF MANUFACTURE THEREOF

(71) Applicant: PAT MCGRATH COSMETICS LLC, New York, NY (US)

(72) Inventor: Patricia McGrath, New York, NY (US)

( * ) Notice: Subject to any disclaimer, the term of this patent is extended or adjusted under 35 U.S.C. 154(b) by 24 days.

(21) Appl. No.: 18/052,199

(22) Filed: Nov. 2, 2022

(65) Prior Publication Data

US 2023/0174286 A1 Jun. 8, 2023

Related U.S. Application Data

(62) Division of application No. 17/053,392, filed on Nov. 6, 2020, now Pat. No. 11,518,599.

(51) Int. Cl.
*B65D 81/09* (2006.01)
*B65D 33/00* (2006.01)
(Continued)

(52) U.S. Cl.
CPC ..... *B65D 81/09* (2013.01); *B65D 33/004* (2013.01); *B65D 33/2533* (2013.01);
(Continued)

(58) Field of Classification Search
CPC .... B65D 31/12; B65D 33/04; B65D 33/2533; B65D 81/2084; B65D 81/09;
(Continued)

(56) References Cited

U.S. PATENT DOCUMENTS 3,138,248 A 6/1964 Abbott
3,302,780 A 2/1967 Massman et al.
(Continued)

FOREIGN PATENT DOCUMENTS

CN 1062119 A 6/1992
CN 102099185 A 6/2011
(Continued)

OTHER PUBLICATIONS

Combined Search and Examination Report under Sections 17 and 18(3) issued in GB Patent Application GB1807578.8 on Nov. 8, 2018, 6 pages.
(Continued)

*Primary Examiner* — Thomas M Wittenschlaeger
(74) *Attorney, Agent, or Firm* — RC Trademark Company

(57) ABSTRACT

Disclosed is a product pouch arrangement and method of (for) manufacture thereof. The product pouch arrangement includes at least a first compartment and a second compartment, the first compartment in use includes a plurality of shock cushioning elements that cushion the one or more products, and also optically protect the one or more products, the second compartment accommodates in use the one or more products, at least one of the first and second compartments are resealable so that the one or more products and/or the plurality of cushioning elements are user-accessible and the first and second compartments have surrounding walls that are fabricated from at least one flexible plastics material that transmits electromagnetic radiation in a wavelength range to which a human eye responds but attenuates radiation in an ultra violet (UV) electromagnetic wavelength range.

7 Claims, 5 Drawing Sheets

(51) Int. Cl.

| | |
|---|---|
| ***B65D 33/25*** | (2006.01) |
| ***B65D 65/20*** | (2006.01) |
| ***B65D 81/20*** | (2006.01) |
| ***B65D 81/32*** | (2006.01) |

(52) U.S. Cl.
CPC ..... *B65D 65/20* (2013.01); *B65D 81/2084* (2013.01); *B65D 81/3261* (2013.01); *B65D 2203/12* (2013.01); *B65D 2565/388* (2013.01)

(58) Field of Classification Search
CPC ..... B65D 81/3261; B65D 65/20; B65D 2565/388; B65D 2203/12
See application file for complete search history.

(56) References Cited

U.S. PATENT DOCUMENTS

| | | | | |
|---|---|---|---|---|
| 4,162,696 | A * | 7/1979 | Sprung | G03B 17/561 396/419 |
| 4,193,499 | A | 3/1980 | Lookholder | |
| 4,620,633 | A | 11/1986 | Lookholder | |
| 5,372,429 | A | 12/1994 | Beaver, Jr. et al. | |
| 5,791,476 | A | 8/1998 | Stekloff | |
| 6,877,601 | B1 * | 4/2005 | Colombo | B65D 81/2076 53/434 |
| 2004/0140233 | A1 * | 7/2004 | Ajootian | B65D 33/14 206/461 |
| 2006/0219595 | A1 | 10/2006 | Peters | |
| 2007/0206888 | A1 | 9/2007 | Chang | |
| 2009/0123681 | A1 * | 5/2009 | Weder | B65D 81/09 156/61 |
| 2016/0229622 | A1 | 8/2016 | Booska | |
| 2018/0043070 | A1 * | 2/2018 | Habig | B65D 83/0805 |
| 2018/0050856 | A1 | 2/2018 | Baud et al. | |

FOREIGN PATENT DOCUMENTS

| | | | | |
|---|---|---|---|---|
| CN | 105000281 | A | 10/2015 | |
| DE | 4015768 | A1 * | 11/1991 | B65D 81/09 |
| FR | 2847233 | A1 | 5/2004 | |
| GB | 1009156 | A | 11/1965 | |
| WO | 2006034123 | A2 | 3/2006 | |
| WO | 2010027776 | A1 | 3/2010 | |

OTHER PUBLICATIONS

Notification of transmittal of the International Search Report and the written opinion of the International Searching Authority, or the declaration issued in PCT Application PCT/IB2019/053820 on Oct. 29, 2019, 12 pages.

Notification concerning Transmittal of international Preliminary report on patentability issued in PCT Application PCT/IB2019/053820 on Nov. 19, 2020, 7 pages.

* cited by examiner

PRODUCT POUCH ARRANGEMENT AND METHOD OF MANUFACTURE THEREOF

TECHNICAL FIELD

The present disclosure relates generally to product pouch arrangements, namely to product pouch arrangements that employ a plurality of shock absorbing elements to protect one or more products included therein from physical damage when handled. Moreover, the present disclosure also relates to methods of (for) manufacturing aforesaid product pouch arrangements.

BACKGROUND

The use of containers fabricated from glass and/or plastics materials (for example Perspex®, optically transparent polycarbonate, and so forth) for packaging products such as food items, beverages, cosmetics and so forth has been increasing in popularity in more recent years. Typically, such a packaging ensures a longer shelf life of a product stored inside the packaging. The packaging provides a non-porous membrane that restricts any interactions between external contamination and the product; the external contamination includes dust particles, bacterial, mould, humidity. Additionally, the packaging provides users with an increased visibility to the product stored within the packaging. However, such packaging has associated therewith a risk of breakage of the membrane that is often mechanically brittle or fragile. Often, a protective layer is used in conjunction with the packaging to reduce a risk of damage to the aforesaid membrane.

However, such a protective layer potentially obscures an optical visibility to the product. Furthermore, in some examples, the protective layer of the packaging may not be aesthetically appealing to a potential customer. Moreover, the marketing of the product may be severely affected due to such an unappealing nature of the protective layer. Furthermore, the protective layer potentially does not protect the product from the harmful radiations in the atmosphere, for example in an event that the product is displayed in a sunlit area where ultraviolet (UV) radiation can cause discoloration or denaturing of the product; such harmful radiation can potentially contaminate the product or decrease a shelf life of the product.

Conventionally, packaging materials such as polythene packaging, blister packaging, PVC packaging, styrofoam, and so forth are utilized as protective layers to prevent glass or plastics materials packaging from breakage. However, such protective layers are aesthetically unappealing and further reduce external visibility of the product.

Therefore, in light of the foregoing discussion, there exists a need to overcome the aforementioned drawbacks associated with the conventional protective layer of such packaging.

SUMMARY

The present disclosure seeks to provide a product pouch arrangement that that protects one or more products included therein from physical damage when handled and presented to potential customers for purchase.

The present disclosure also seeks to provide a method of (for) manufacturing a product pouch arrangement that protects one or more products included therein from physical damage when handled and presented to potential customers for purchase.

According to a first aspect, an embodiment of the present disclosure provides a product pouch arrangement that protects one or more products included therein from physical damage when handled, characterized in that:

(i) the product pouch arrangement includes at least a first compartment and a second compartment;

(ii) the first compartment in use includes a plurality of shock cushioning elements that cushion the one or more products, and also optically protect the one or more products;

(iii) the second compartment accommodates in use the one or more products;

(iv) at least one of the first and second compartments are resealable so that the one or more products and/or the plurality of cushioning elements are user-accessible; and (v) the first and second compartments have surrounding walls that are fabricated from at least one flexible plastics material that transmits electromagnetic radiation in a wavelength range to which a human eye responds but attenuates radiation in an ultra violet (UV) electromagnetic wavelength range.

The product pouch arrangement with the plurality of shock absorbing elements enable the protection of one or more products from any physical damage when handled. Additionally, the product pouch arrangement provides preferential visibility to the one or more product stored therein. Beneficially, the product pouch arrangement provides increased appreciative appeal to the product thereby attracting new customers.

By "transmits" is meant at least 60% transmissive to radiation wavelengths to which the human eye responds, for example at least 80% transmissive to radiation wavelengths to which the human eye responds. By "attenuates" is meant attenuating by at least 20% of radiation at a UV region of the electromagnetic spectrum, for example in a radiation wavelength range of 10 nm to 400 nm, for example attenuating by at least 50% at the UV region of the electromagnetic spectrum. The human eye is assumed here to be response to radiation having a wavelength in a range of 400 nm to 780 nm.

Optionally, the plurality of shock cushioning elements are implemented as planar discs, wherein the planar discs have peripheral out-of-plane features that absorb shock in operation.

Optionally, the surrounding walls of the first and second compartment are thermally welded along at least a part of their peripheral edges.

Optionally, at least one of the first and second compartment is user-accessible via a zip-sealing arrangement implemented using mutually interlocking mutually parallel elongate ridges formed from a flexible plastics material.

Optionally, the plurality of shock cushioning elements have formed thereonto one or more holographic images or micro-embossed images as an anti-counterfeiting feature.

Optionally, the micro-embossed images are formed to cooperate with micro-embossed features formed into the surrounding walls of the first and/or second compartment, to form Moiré-fringes that are discernible by a naked human eye.

Optionally, the plurality of shock cushioning elements are fabricated from a plastics material or metal sheet having an optically reflecting planar surface.

Optionally, the first compartment including the plurality of shock cushioning elements has a wall separating the first compartment from the second compartment that supports gaseous communication between the compartments, wherein the first compartment includes a volatile aromatic substance or a preserving agent substance that gaseously diffuses to the second compartment to perfume the one or more products and/or to assist in preservation of the one or more products.

Optionally, the wall separating the first compartment from the second compartment is provided with an array of diffusion holes that support gaseous diffusion from the first compart to the second compartment with a diffusion time constant (1/e) of greater than 24 hours at 20° C.

Optionally, the product pouch arrangement includes a tearable seal that is user-rippable when initially accessing at least one of the first and second compartments.

Optionally, the walls of the first compartment are provided with an adhesive arrangement for maintaining a portion of the shock cushioning elements in a fixed spatial relation to the walls of the first compartment by being adhesively attached thereto.

Optionally, a length of the peripheral edges of the of the first and second compartment is in range of 2 inches (50 mm) to 15 inches (500 mm).

Optionally, the at least one flexible plastics material comprises at least one of: low-density polyethylene, high-density polyethylene, polypropylene, polyethylene terephthalate, polyvinyl chloride.

Optionally, the product pouch arrangement includes an opening on a peripheral edge thereof, wherein the opening enables access to at least one of the first and/or second compartments.

Optionally, the peripheral edges of the product pouch arrangement have a metallic glossy texture.

Optionally, a thickness of the at least one flexible plastics material is in a range of 35 microns to 250 microns.

Optionally, a flexural modulus of the at least one flexible plastics material is in a range of 0.5 GigaPascals to 3 GigaPascals.

Optionally, a number of the plurality of shock cushioning elements is in a range of 100 to 10,000.

In a second aspect, an embodiment of the present disclosure provides a method of (for) manufacturing a product pouch arrangement that protects one or more products included therein from physical damage when handled, characterized in that the method includes:

(i) arranging for the product pouch arrangement to include at least a first compartment and a second compartment, wherein the first and second compartments have surrounding walls that are fabricated from at least one flexible plastics material that transmits electromagnetic radiation in a wavelength range to which a human eye responds but attenuates radiation in an ultra violet (UV) electromagnetic wavelength range;

(ii) inserting into the first compartment a plurality of shock cushioning elements that cushion in operation the one or more products, also optically protect the one or more products;

(iii) inserting into the second compartment the one or more products; and (iv) arranging for at least one of the first and second compartments to be resealable so that the one or more products and/or the plurality of cushioning elements are user-accessible.

Optionally, the method includes implementing the plurality of shock cushioning elements as planar discs, wherein the planar discs have peripheral out-of-plane features that absorb shock in operation.

Optionally, the method includes thermally welding the surrounding walls of the first and second compartment along at least a part of their peripheral edges.

Optionally, the method includes arranging for at least one of the first and second compartment to be user-accessible via a zip-sealing arrangement implemented using mutually interlocking mutually parallel elongate ridges formed from a flexible plastics material.

Optionally, the method includes forming onto the plurality of shock cushioning elements one or more holographic images or micro-embossed images as an anti-counterfeiting feature.

Optionally, the micro-embossed images are formed to cooperate with micro-embossed features formed into the surrounding walls of the first and/or second compartment, to form Moiré-fringes that are discernible by a naked human eye.

Optionally, the method includes fabricating the plurality of shock cushioning elements from a plastics material or metal sheet having an optically reflecting planar surface.

Optionally, the method includes arranging for the first compartment to include the plurality of shock cushioning elements having a wall separating the first compartment from the second compartment that supports gaseous communication between the compartments, wherein the first compartment includes a volatile aromatic substance or preserving agent substance that gaseously diffuses to the second compartment to perfume the one or more products and/or to assist in preservation of the one or more products.

Optionally, the method includes providing the wall separating the first compartment from the second compartment with an array of diffusion holes that support gaseous diffusion from the first compart to the second compartment with a diffusion time constant (1/e) of greater than 24 hours at 20° C.

Optionally, the method includes arranging for the product pouch arrangement to include a tearable seal that is user-rippable when initially accessing at least one of the first and second compartments.

Optionally, the method includes providing the walls of the first compartment with an adhesive arrangement for maintaining a portion of the shock cushioning elements in a fixed spatial relation to the walls of the first compartment by being adhesively attached thereto.

Optionally, the method includes arranging for the at least one flexible plastics material to include at least one of: low-density polyethylene, high-density polyethylene, polypropylene, polyethylene terephthalate, polyvinyl chloride.

Optionally, the method includes arranging for the product pouch arrangement to include an opening on a peripheral edge thereof, wherein the opening enables access to at least one of the first and/or second compartments.

Optionally, the method includes arranging for the peripheral edges of the product pouch arrangement to have a metallic glossy texture.

Optionally, the method is usable for manufacturing a product pouch arrangement.

According to a third aspect, an embodiment of the present disclosure provides a product pouch arrangement that protects one or more products included therein from physical damage when handled, characterized in that:

(i) the product pouch arrangement includes at least a first compartment and a second compartment;

(ii) the first compartment in use includes a plurality of shock cushioning elements that cushion the one or more products;

(iii) the second compartment accommodates in use the one or more products;

(iv) at least one of the first and second compartments are resealable so that the one or more products and/or the plurality of cushioning elements are user-accessible;

(v) the first and second compartments have surrounding walls that are fabricated from at least one flexible plastics material.

According to a fourth aspect, an embodiment of the present disclosure provides a product pouch arrangement that protects one or more products included therein from physical damage when handled, characterized in that:

(i) the product pouch arrangement includes at least a first compartment;

(ii) the at least first compartment in use includes a plurality of shock cushioning elements that cushion the one or more products included in the product pouch arrangement;

(iv) the at least first compartment is sealed so that the plurality of cushioning elements are user-inaccessible; and (v) the at least first compartment has surrounding walls that are fabricated from at least one flexible plastics material.

Optionally, the product pouch arrangement only includes one compartment.

According to a fifth aspect, an embodiment of the present disclosure provides a product pouch arrangement that protects one or more products included therein from physical damage when handled, characterized in that:

(i) the product pouch arrangement includes at least a first compartment and a second compartment;

(ii) the first compartment in use includes a plurality of shock cushioning elements that cushion the one or more products, wherein the plurality of shock cushioning elements have formed thereonto one or more holographic images or micro-embossed images as an anti-counterfeiting feature;

(iii) the second compartment accommodates in use the one or more products;

(iv) at least one of the first and second compartments are resealable so that the one or more products and/or the plurality of cushioning elements are user-accessible; and (v) the first and second compartments have surrounding walls that are fabricated from at least one flexible plastics material.

Optionally, the micro-embossed images are formed to cooperate with micro-embossed features formed into the surrounding walls of the first and/or second compartment, to form Moiré-fringes that are discernible by a naked human eye.

According to a sixth aspect, there is provided a product pouch arrangement that protects one or more products included therein from physical damage when handled, characterized in that:

(i) the product pouch arrangement includes at least a first compartment and a second compartment;

(ii) the first compartment in use includes a plurality of shock cushioning elements that cushion the one or more products;

(iii) the second compartment accommodates in use the one or more products;

(iv) at least one of the first and second compartments are resealable so that the one or more products and/or the plurality of cushioning elements are user-accessible; and (v) the first and second compartments have surrounding walls that are fabricated from at least one flexible plastics material, wherein the surrounding walls of the first and second compartment are thermally welded along at least a part of their peripheral edges.

According to a seventh aspect, there is provided a product pouch arrangement that protects one or more products included therein from physical damage when handled, characterized in that:

(i) the product pouch arrangement includes at least a first compartment and a second compartment;

(ii) the first compartment in use includes a plurality of shock cushioning elements that cushion the one or more products;

(iii) the second compartment accommodates in use the one or more products;

(iv) the first compartment including the plurality of shock cushioning elements has a wall separating the first compartment from the second compartment that supports gaseous communication between the compartments, wherein the first compartment includes a volatile aromatic substance or preserving agent substance that gaseously diffuses to the second compartment to perfume the one or more products and/or to assist in preservation of the one or more products; and (iv) the first and second compartments have surrounding walls that are fabricated from at least one flexible plastics material.

Optionally, at least one of the first and second compartments are resealable so that the one or more products and/or the plurality of cushioning elements are user-accessible. Optionally, at least one of the first and second compartments are non-resealable.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
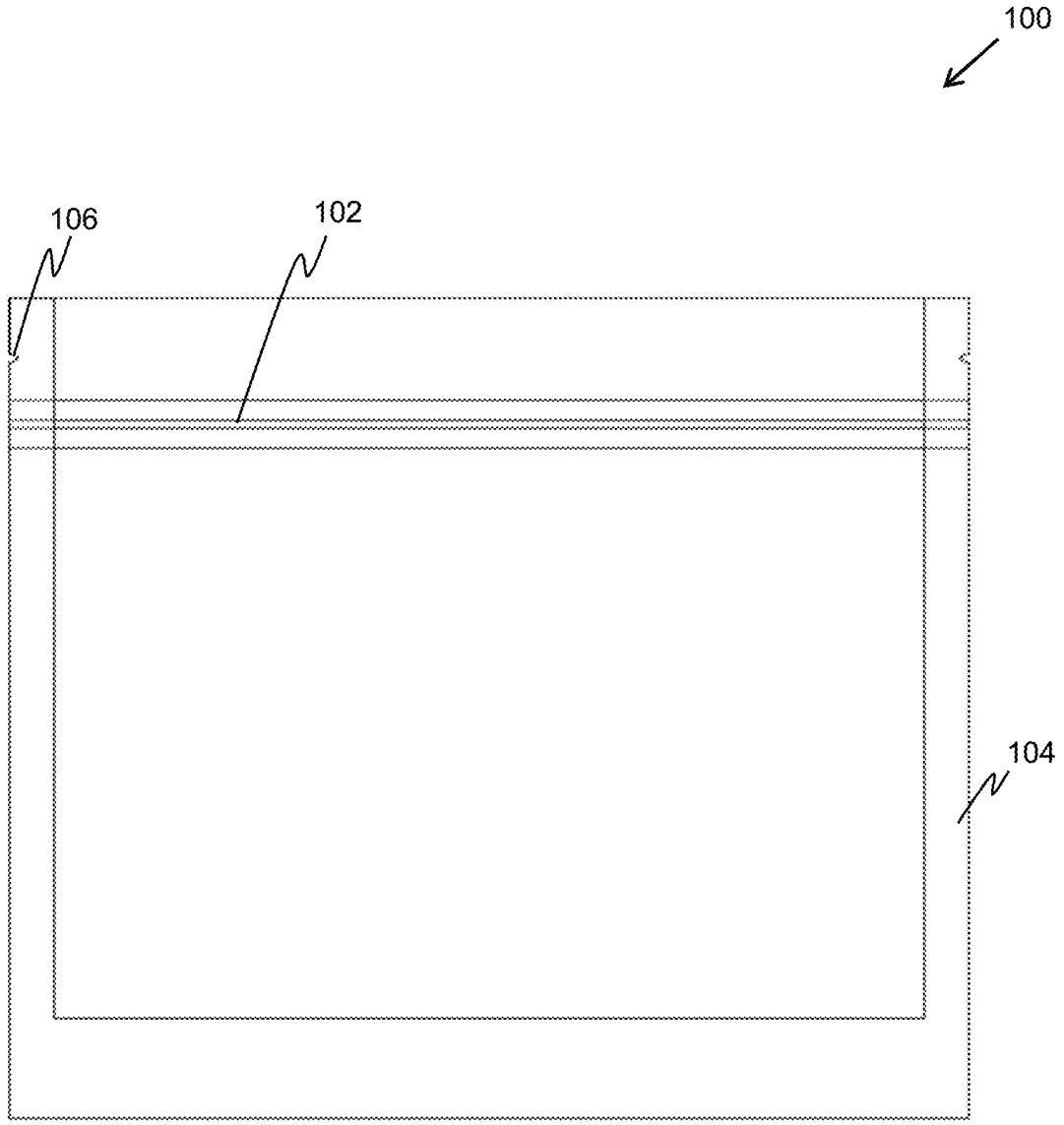
FIG. 1 is an illustration of a front view of a product pouch arrangement, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

In overview, embodiments of the present disclosure are concerned with a product pouch arrangement that protects one or more products included therein from physical damage when handled and presented to potential customers, and a method of (for) manufacture thereof.

The product pouch arrangement, and the method of (for) manufacturing a product pouch arrangement as described in the present disclosure, enables the protection of one or more products included therein. Beneficially, the product pouch arrangement prevents the one or more products from any physical damage when handled. Typically, the product pouch arrangement includes at least two compartments (for example, two compartments, three compartments, four compartments, and so forth), wherein a first compartment of the at least two compartments is at least partially filled (for example at least 90% filled) with a plurality of shock cushioning elements. Furthermore, the plurality of shock cushioning elements absorbs in operation any mechanical shock applied on the packaging, and further prevents (or reduces a risk of) the one or more products from any fracture or breakage. Notably, the one or more products are stored in a second compartment of the at least two compartments of the product pouch arrangement. Subsequently, the plurality of shock cushioning elements stored in the first compartment prevents do not obscure, for example, a comprehensive visibility of the one or more products. However, the product pouch arrangement ensures preferential visibility of the one or more products stored therein. Furthermore, the product pouch arrangement ensures the protection of the one or more products from the harmful radiations such as UV radiations arising from ambient illumination. Typically, the product pouch arrangement attenuates the harmful radiations thereby preventing contamination or denaturing of the one or more products. Furthermore, the plurality of shock cushioning elements have formed thereonto one or more holographic images or micro-embossed images. Furthermore, the micro-embossed images along with the micro-embossed feature of the surroundings is operable to form a Moiré-fringes that are visible to naked eyes. Advantageously, such Moiré-fringes are visually appealing and aesthetically pleasing to the customers. Additionally, such Moiré-fringes may further to attract new customers. Furthermore, the first compartment of the product pouch arrangement includes an aromatic substance; optionally, when present, the aromatic substance is included in a third compartment of the product pouch arrangement. Additionally, such aromatic substance optionally acts as a preserving agent and further assists the preservation of the one or more products thereby increasing the shelf life of the one or more products. Such preservation is especially beneficial when the one or more products are perishable items that can potentially undergo denaturing, for example certain type of cosmetics products such as lipsticks, eye shadows, mascaras, makeup powders, blush, pens, creams and lotions.

The product pouch arrangement protects in operation one or more products included therein from physical damage when handled. The product pouch arrangement is used for packaging and transportation of the one or more products. Furthermore, in a situation where the one or more products are prone to physical damage during transportation and handling, the product pouch arrangement protects in operation the one or more products.

Throughout the present disclosure, the term "one or more products" relates to an article, a substance, a commodity, an object or a material required to be packaged and transported for sales, marketing, production and is to meet a market need. Furthermore, the one or more product may comprise a packaging (such as a glass or plastics material packaging) thereof to contain material present inside the one or more products. Examples of the one or more products include, but are not limited to, pharmaceutical products, cosmetics, consumable articles such as food and beverages, stationery items, electronic products.

The product pouch arrangement includes at least a first compartment and a second compartment. Specifically, the product pouch arrangement includes at least the first compartment and the second compartment inside thereof. More specifically, the first compartment and the second compartment are only accessible after opening the product pouch arrangement. Consequently, contents of at least one of the first compartment and the second compartment are only accessible after opening the product pouch arrangement (explained in greater detail hereinafter).

Optionally, the product pouch arrangement includes a tearable seal that is user-rippable when initially accessing at least one of the first and second compartments. Specifically, in operation, the user rips (namely, tears) the tearable seal when initially accessing at least one of the first and second compartments. Furthermore, the product pouch arrangement may include a notch at a point where the tearable seal contacts a peripheral edge of the product pouch arrangement. Consequently, the user may use the notch to initiate ripping of the tearable seal therefrom, wherein the notch spatially concentrates a ripping force applied by the user to open the product pouch arrangement.

Optionally, the product pouch arrangement includes an opening on a peripheral edge thereof, wherein the opening enables access to at least one of the first and/or second compartments.

Specifically, the user may rip the tearable seal to access the opening on the peripheral edge of the product pouch arrangement. Furthermore, after ripping the tearable seal, the user may access the contents of at least one of the first and second compartments using the opening on the peripheral edge of the product pouch arrangement.

Optionally, surrounding walls of the first and second compartment are thermally welded together along at least a part of their peripheral edges. Specifically, the first and second compartments comprise the surrounding walls to sandwich the contents thereof therebetween. Consequently, the surrounding walls are thermally welded along at least a part of their peripheral edges to seal the contents of the first and second compartments. Notably, at least the part of the peripheral edges of the first and second compartment are placed together, wherein thermal stimulus may be applied on at least the part of the peripheral edges to seal them together. Alternatively, at least some thermal welding is performed and then the contents of the first and second compartments are inserted.

Optionally, a length of the peripheral edges of the first and second compartment is in range of 2 inches to 15 inches (circa 50 mm to 500 mm). In an embodiment, the first and the second compartments may be rectangular. In an example, the elongate side of the first and second compartments may be 5 inches (circa 125 mm) in length and the shorter side of the first and second compartments may be 8 inches (circa 200 mm) in length. In another embodiment, the first and second compartments may be square shaped (in plan view). In an example, the peripheral edges of the first and second compartments is 9 inches (circa 225 mm) in length.

Throughout the present disclosure, the term "shock cushioning elements" relates to objects that allow for providing at least a cushioning effect to the one or more products, wherein such objects are employed within the first compartment of the product pouch arrangement. Furthermore, such objects also provide optical protection to the one or more products. Notably, the plurality of shock cushioning elements cushion (namely, soften effect of an impact thereupon) the one or more products that are accommodated in the second compartment of the product pouch arrangement against impacts such as, but not limited to, placement of the product pouch arrangement on a surface, dropping the product pouch arrangement, transportation of the product pouch arrangement, and handling the product pouch arrangement during use. Furthermore, the plurality of shock cushioning elements optically protect the one or more products against unwanted electromagnetic radiation (for example, such as radiation in an ultra violet electromagnetic range) that could possibly damage or otherwise denature the one or more products. Optionally, the plurality of shock cushioning elements are implemented by way of a plurality of sequin-type elements; sequins are, for example, often sewn onto external surface of fashion clothing and such like, for achieving a glitzy optical effect.

It will be appreciated that the plurality of shock cushioning elements provide the aforesaid cushioning effect (namely, physical buffering effect or padding effect) and the aforesaid optical protection to the one or more products, whilst enabling the one or more products to be viewed (for example, by a seller, a potential buyer, and the like). In other words, the plurality of shock cushioning elements provide the cushioning effect and the optical protection to the one or more products in a non-obstructive manner. Furthermore, it will be appreciated that the plurality of shock cushioning elements could also be referred to as a "plurality of impact cushioning elements", a "plurality of shock protective elements", and the like.

Optionally, the plurality of shock cushioning elements are mutually equal in size. Alternatively, optionally, the plurality of shock cushioning elements are unequal in size, for example having a minimum to maximum size ration in a range of 1:5 to 1:1.5.

Optionally, the plurality of shock cushioning elements enhance a visual appearance of the product pouch arrangement. In such an example, a visual appearance of the plurality of shock cushioning elements allows for enhancing the overall visual appearance of the product pouch arrangement. In one example, the plurality of shock cushioning elements may glitter when exposed to light. In another example, the plurality of shock cushioning elements may be coloured, for example glittering bright colours (for example, such as red, yellow, pink, green, and the like) when exposed to incident optical illuminating radiation (in a wavelength range to which the human eye is sensitive). It will be appreciated that the plurality of shock cushioning elements beneficially enhance the visual appearance of the product pouch arrangement in a manner that allows for attracting a potential buyer's (namely, purchaser's) attention towards the product pouch arrangement (i.e. enhances aesthetic appeal).

The first compartment in use includes a plurality of shock cushioning elements that cushion the one or more products, and also optically protect the one or more products. Specifically, the plurality of shock cushioning elements protect the one or more products by absorbing a shock impact on the product pouch arrangement. Furthermore, the plurality of shock cushioning elements cover at least partially the one or more products in all configurations and implementations of the product pouch arrangement. Consequently, the plurality of shock cushioning elements optically protect (at least partially) the one or more products by covering at least partially the one or more products. Specifically, the plurality of shock cushioning elements cover the one or more products and thus restrict visual appearance of the one or more products from the exterior of the product pouch arrangement. Furthermore, the plurality of shock cushioning elements may be inserted into the first compartment and the first compartment may be sealed thereafter.

Optionally, a number of the plurality of shock cushioning elements is in a range of 100 to 10,000. Optionally, in this regard, the greater the number of the plurality of shock cushioning elements, the greater is a magnitude of the cushioning effect provided by the plurality of shock cushioning elements. In an example implementation, the number of the plurality of shock cushioning elements may be, for example, 100, 150, 200, 250, 300, 350, 400, 450, 500, 550, 600, 650, 700, 750, 800, 850, 900, 950 or 1000. In another example implementation, the number of the plurality of shock cushioning elements may be, for example, 1000, 1500, 2000, 2500, 3000, 3500, 4000, 4500, 5000, 5500, 6000, 6500, 7000, 7500, 8000, 8500, 9000, 9500, or 10000.

Alternatively, optionally, the number of the plurality of shock cushioning elements is lesser than 100 or greater than 10,000.

Optionally, the plurality of shock cushioning elements are implemented as planar discs, wherein the planar discs have one or more peripheral out-of-plane features that absorb mechanical shock in operation. In such an example, the term "planar discs" relates to disc-like objects having a substantially-flat (namely, planar) surface, and out-of-plane features along a periphery of the substantially-flat surface. Notably, the peripheral out-of-plane features lie along multiple planes that are different from the planar surfaces of the planar discs. It will be appreciated that such peripheral out-of-plane features allow for increasing a surface area of the planar discs across multiple planes, thereby, providing large shock absorbing surfaces associated with the planar discs. Furthermore, such peripheral out-of-plane features provide room for the planar discs to deform when subjected to shock (namely, impact), thereby, providing the cushioning effect to the one or more products.

Optionally, a shape of the planar discs is selected from the group consisting of: a circle, an ellipse, a polygon, a flat-freeform shape, a curved conical surface, a sphere, an obloid.

In an example, the plurality of shock cushioning elements may be implemented as planar discs having a circular peripheral shape. In such an example, each of the planar discs may have in a range of 3 to 10 out-of-plane features, for example 6 out-of-plane features, for example regularly disposed around a peripheral edge of the planar discs.

In another example, the plurality of shock cushioning elements may be implemented as planar discs having a pentagonal shape. In such a case, each of the planar discs may have 5 out-of-plane features.

In yet another example, the plurality of shock cushioning elements may be implemented as planar discs having a flat-freeform star-like shape. In such a case, each of the planar discs may have at least 3 out-of-plane features.

Optionally, the plurality of shock cushioning elements are implemented as freeform elements, wherein the freeform elements have freeform features that absorb shock in operation. Notably, the freeform elements have a substantially-freeform shape (namely, a shape having protrusions and/or depressions). In an example, the plurality of shock cushioning elements may be implemented as freeform elements having a three-dimensional flower-like shape. In such an example, petals of the flower-like freeform elements constitute the freeform features of the plurality of shock cushioning elements.

Optionally, the plurality of shock cushioning elements have formed thereonto one or more holographic images or micro-embossed images as an anti-counterfeiting feature. In such a case, the one or more holographic images or the micro-embossed images allow for providing a unique identification of the plurality of shock cushioning elements. Such a unique identification can be employed to differentiate genuine shock cushioning elements from counterfeit shock cushioning elements. It will be appreciated that a size of the one or more holographic images or the micro-embossed images is lesser than or equal to a size of the plurality of shock cushioning elements.

Optionally, the one or more holographic images or micro-embossed images pertain to a manufacturer of the product pouch arrangement. In such a case, the one or more holographic images or micro-embossed images could depict, for example, a logo of the manufacturer of the product pouch arrangement, branding colours of the manufacturer of the product pouch arrangement, a name of the manufacturer of the product pouch arrangement, a unique identification number of the plurality of shock cushioning elements, and the like.

Optionally, the micro-embossed images are formed to cooperate with micro-embossed features formed into the surrounding walls of the first and/or second compartment, to form Moiré-fringes that are discernible by a naked human eye. In such a case, both the micro-embossed images formed onto the plurality of shock cushioning elements and the micro-embossed features formed into the surrounding walls of the first and/or second compartment, depict opaque ruled patterns which are substantially similar to each other. Furthermore, the opaque ruled patterns of the micro-embossed images corresponding to the plurality of shock cushioning elements and the surrounding walls of the first and/or second compartment are displaced with respect to each other (for example, linearly displaced, rotated, and the like), to form the Moiré-fringes. It will be appreciated that such Moiré fringes also allow for enhancing the visual appearance of the product pouch arrangement, as described previously.

Optionally, the plurality of shock cushioning elements are fabricated from a plastics material or metal sheet having at least one optically reflecting planar surface, for example two principal surfaces that are optically reflective. In such an example, plastics material that may be used to manufacture the shock cushioning elements include Polyethylene terephthalate, Polyvinyl Chloride, and the like. The metal sheet having the optically reflective planar surface could be a steel sheet, an aluminium sheet, a brass sheet, a copper sheet, a silver or silver-plated sheet, and the like. It will be appreciated that the aforesaid materials that are employed for fabrication of the plurality of shock cushioning elements are lightweight, cost-effective, and allow for easy manufacturability of the plurality of shock cushioning elements (for example, by punching out from sheets of material, by laser cutting, by photolithographic etching, and so forth).

Optionally, the walls of the first compartment are provided with an adhesive arrangement for maintaining a portion of the shock cushioning elements in a fixed spatial relation to the walls of the first compartment by being adhesively attached thereto. Optionally, in this regard, the adhesive arrangement includes at least one adhesive material that allows for providing adhesion between the material of the shock cushioning elements and at least one flexible plastics material of the walls of the first compartment. Notably, an inner surface of the walls of the first compartment are lined with the adhesive arrangement to maintain the portion of the shock cushioning elements in the aforesaid manner. It will be appreciated that maintaining the portion of the shock cushioning elements in a fixed spatial relation to the walls of the first compartment by being adhesively attached thereto allows for ensuring that the portion of shock cushioning elements are substantially-equally distributed along an entire surface of the walls of the first compartment; they also assist to maintain non-adhesively-bonded shock cushioning elements in a preferred spatial distribution within the first compartment. As a result, the one or more products accommodated in the second compartment remain protected from shock (namely, impact) at all times, irrespective of orientation of the product pouch arrangement. Notably, when the orientation of the product pouch arrangement is changed (for example, whilst inspecting the product pouch arrangement in one's hand), a remaining portion of the shock cushioning elements that is not adhesively attached to the walls of the first compartment may shift within the first compartment. Examples of the at least one adhesive material (of the adhesive arrangement) include, but are not limited to, a glue, an adhesive tape, an adhesive, a vapour-deposited adhesive film and an epoxy resin.

The second compartment accommodates in use the one or more products. Specifically, the one or more products are inserted into the second compartment. More specifically, a spatial orientation of the one or more products is considered prior to accommodating the one or more products in the second compartment to ensure optical and physical protection by the plurality of shock cushioning elements. It will be appreciated that the one or more products are at least partially visible from an exterior of the product pouch arrangement.

In an embodiment, the product pouch arrangement comprises a unitary compartment, wherein the plurality of shock cushioning elements and the one or more products are accommodated in the unitary compartment.

Furthermore, at least one of the first and second compartments are resealable so that the one or more products and/or the plurality of shock cushioning elements are user-accessible. In an example embodiment, at least one of the first and second compartments are resealable so that the user is able to access the first compartment to change a quantity of the plurality of shock cushioning elements, add another type of plurality of shock cushioning elements or remove the plurality of shock cushioning elements from the first compartment altogether and reseal (for example, for using the shock cushioning elements for making jewellery and similar decorative handicrafts). In another example, at least one of the first and second compartments are resealable so that the user is operable to access the second compartment to retrieve the one or more products therefrom, replace the one or more products in the second compartment and reseal thereafter.

Optionally, at least one of the first and second compartments are user-accessible via a zip-sealing arrangement implemented using mutually interlocking mutually parallel elongate ridges formed from a flexible plastics material. Specifically, the zip-sealing arrangement is used to reseal at least one of the first and second compartments. Furthermore, the zip-sealing arrangement may comprise mutually interlocking elements implemented on the mutually parallel elongate ridges, wherein interlocking elements implemented on one of the parallel elongate ridges interlock with the interlocking elements other parallel elongate ridge. Moreover, the zip-sealing arrangement may provide an air-tight resealing of the at least one of the first and second compartments to provide protection to the plurality of shock cushioning elements and the one or more products from multiple environmental factors.

The first and second compartments have surrounding walls that are fabricated from at least one flexible plastics material. Specifically, the first and second compartments have surrounding walls. More specifically, a first surrounding wall of the first compartment corresponds to a first exterior wall of the product pouch arrangement. Similarly, a second surrounding wall of the second compartment corresponds to a second exterior wall of the product pouch arrangement. Consequently, the second surrounding wall of the first compartment and the first surrounding wall of the second compartment are implemented as a unitary wall. In other words, the plurality of shock cushioning elements are accommodated between the first surrounding wall of the first compartment (also, the first exterior wall of the product pouch arrangement) and the second surrounding wall of the first compartment (also, the first surrounding wall of the second compartment). Similarly, the one or more products are accommodated between the first surrounding wall of the second compartment (also, the second surrounding wall of the first compartment) and the second surrounding wall of the second compartment (also, the second exterior wall of the product pouch arrangement).

Moreover, the at least one flexible plastics material transmits electromagnetic radiation in a wavelength range to which a human eye responds (namely 780 nm to 400 nm) but attenuates radiation in an ultra violet (UV) electromagnetic wavelength range (namely 400 nm to 10 nm): by "attenuates" means at least 10% attenuation, more optionally at least 25% attenuation, yet more optionally at least 50% attenuation, and yet more optionally at last 75% attenuation. Specifically, the at least one flexible plastics material is subject to electromagnetic radiations incident thereupon in different ranges of the electromagnetic spectrum. More specifically, the at least one flexible plastics material allows electromagnetic radiations (incident thereupon) in visible wavelength range of the electromagnetic spectrum to pass therethrough. However, the at least one flexible plastics material either absorbs or reflects electromagnetic radiation (incident thereupon) in the ultra violet (UV) wavelength range of the electromagnetic spectrum. Beneficially, the at least one flexible plastics material protects (namely, shields) the one or more products present in the second compartment from electromagnetic radiation in ultra violet electromagnetic wavelength range and prevents damage, for example discoloration and/or denaturing, of the one or more products.

Optionally, the at least one flexible plastics material comprises at least one of: low-density polyethylene, high-density polyethylene, polypropylene, polyethylene terephthalate, polyvinyl chloride. In an embodiment, the surrounding walls of the first and second compartment may be fabricated using different flexible plastics materials. Furthermore, the choice of at least one flexible plastics material is based on strength, opacity, flexibility, thickness, texture of the at least one flexible plastics material.

Optionally, the at least one flexible plastics material is provided with a coating thereupon. Specifically, such coating on the at least one flexible plastics material may enable attenuation of electromagnetic radiation in the ultra violet (UV) electromagnetic wavelength range (10 nm to 400 nm).

Optionally, a thickness of the at least one flexible plastics material is in a range of 35 microns to 250 microns (m). Optionally, in this regard, the thickness of the at least one flexible plastics material is selected based on a nature of the one or more products accommodated in the second compartment. Specifically, a greater thickness of the at least one flexible plastics material may provide superior protection and support to the one or products and the plurality of shock cushioning elements. In an exemplary implementation, the thickness of the at least one flexible plastics material may be, for example, at least 35 microns, optionally at least 40 microns, optionally at least 50 microns, optionally at least 60 microns, optionally at least 70 microns, optionally at least 80 microns, optionally at least 90 microns, and yet more optionally at least 100 microns (m). In another exemplary implementation, the thickness of the at least one flexible plastics material may be, for example, at least 125 microns, at least 150 microns, at least 175 microns, at least 200 microns, at least 225 microns, and yet more optionally at least 250 microns (m).

Alternatively, optionally, the thickness of the at least one flexible plastics material is less than 35 microns (m) or greater than 250 microns (m).

Optionally, a flexural modulus of the at least one flexible plastics material is in a range of 0.5 GigaPascals to 3.0 GigaPascals. Specifically, the flexural modulus of a material is a parameter for flexibility of the material. Optionally, in this regard, greater a value of the flexural modulus, greater is a magnitude of flexibility of the at least one flexible plastics material. In an exemplary implementation, the flexural modulus of the at least one flexible plastics material may be, for example, at least 0.5 GigaPascals, at least 1.0 GigaPascals, at least 1.5 GigaPascals, at least 2.0 GigaPascals, at least 2.5 GigaPascals, at least 3.0 GigaPascals.

Optionally, the first compartment including the plurality of shock cushioning elements has a wall separating the first compartment from the second compartment that supports gaseous communication between the compartments, wherein the first compartment includes a volatile aromatic substance or a preserving agent substance that gaseously diffuses to the second compartment to perfume the one or more products and/or to assist in preservation of the one or more products. It will be appreciated that diffusion of the volatile aromatic substance or the preserving agent substance to perfume the one or more products and/or to assist in preservation of the one or more products, allows for enhancing an experience of a person (for example, such as the seller, the potential buyer, and the like) handling the product pouch arrangement. Notably, the aforesaid wall is referred to hereinabove as the "second surrounding wall of the first compartment". Furthermore, the aforesaid wall can also be referred to as the "unitary wall" when the second surrounding wall of the first compartment and the first surrounding wall of the second compartment are implemented as a single wall. Therefore, the aforesaid wall can be simply understood to be a "middle wall" between the first compartment and the second compartment. Notably, permeability characteristics of the aforesaid wall allow for the wall to support gaseous communication between the first and second compartments. It will be appreciated that the permeability characteristics of the aforesaid wall allow for the aforesaid gaseous communication to be substantially-controlled. In other words, the gaseous diffusion of the volatile aromatic substance or the preserving agent substance from the first compartment to the second compartment is controlled, instead of being uncontrolled (for example, such as dousing the one or more products in the volatile aromatic substance or the preserving agent substance). Notably, the wall separating the first and second compartments could be made of a porous plastic material, a micro-perforated plastic material, and the like, for enabling the aforesaid gaseous communication. It will be appreciated that the volatile aromatic substance or the preserving agent substance are implemented by way of substances that can be exchanged in gaseous form at average room temperature (for example, such as 20 to 25 degrees Celsius). In an example, the volatile aromatic substance is implemented by way of an aromatic agent mixed with alcohol, whilst the preserving agent substance is implemented by way of anti-microbial and anti-oxidant chemical substances.

Optionally, the wall separating the first compartment from the second compartment is provided with an array of diffusion holes that support gaseous diffusion from the first compartment to the second compartment with a diffusion time constant (1/e) (wherein e is approximately 2.71, such that 1/e is approximately 30%) of greater than 24 hours at 20° C., for example in a range of 1 day to 365 days, more optionally in a arrange of 1 day to 180 days. In this regard, the array of diffusion holes could have a systematic arrangement (for example, such as a symmetric arrangement) or a random arrangement. It will be appreciated that the aforesaid diffusion time constant allows for the volatile aromatic substance or the preserving agent substance to be controllably diffused into the second compartment with time. In other words, the aforesaid diffusion time constant allows for controlling a rate of diffusion rate of the volatile aromatic substance or the preserving agent substance to be moderated (namely, neither too fast, nor too slow).

Optionally, within the array of diffusion holes, a number of diffusion holes lies within ranges of 2 to 100. In an implementation, the number of diffusion holes within the array of diffusion holes may be, for example, 2, 3, 4, 5, 6, 7, 8, 9, 10, 15, 20, 25, 30, 35, 40, 45, 50, 60, 65, 70, 75, 80, 85, 90, 95, or 100. Alternatively, a micropore membrane is employed to control a rate of diffusion of the volatile aromatic substance or the preserving agent substance to the one or more products.

Optionally, within the array of diffusion holes, a size of the diffusion holes is equal. Alternatively, optionally, within the array of diffusion holes, the size of the diffusion holes is unequal. It will be appreciated that the size of diffusion holes optionally allows for controlling the rate of diffusion rate of the volatile aromatic substance or the preserving agent substance. As an example, a larger overall size of the diffusion holes (namely, a total size of the diffusion holes) may allow for a larger diffusion rate of the volatile aromatic substance or the preserving agent substance, and vice versa.

Optionally, the peripheral edges of the product pouch arrangement have a metallic glossy texture. Specifically, the peripheral edges of the product pouch arrangement reflect light rays incident thereupon to exude a glossy finish thereof. Furthermore, the peripheral edges of the product pouch arrangement may exhibit an iridescent effect when subject to light rays. Beneficially, the product pouch arrangement is aesthetically pleasant, for example in overall color (colour).

In an example of an embodiment of the present disclosure, a product pouch arrangement is provided that protects one or more products included therein from physical damage when handled, characterized in that:

(i) the product pouch arrangement includes at least a first compartment and a second compartment;
(ii) the first compartment in use includes a plurality of shock cushioning elements that cushion the one or more products;
(iii) the second compartment accommodates in use the one or more products;
(iv) at least one of the first and second compartments are resealable so that the one or more products and/or the plurality of cushioning elements are user-accessible; and
(v) the first and second compartments have surrounding walls that are fabricated from at least one flexible plastics material.

Optionally, the first and second compartments have surrounding walls that are fabricated from at least one flexible plastics material that transmits electromagnetic radiation in a wavelength range to which a human eye responds but attenuates radiation in an ultra violet (UV) electromagnetic wavelength range. Optionally, in such an example, the at least one flexible plastics material of the surrounding walls can, for example, be opaque or substantially non-transmissive to optical radiation in a human eye response range of 780 nm to 400 nm, and also at UV wavelengths in a range of 400 nm to 10 nm. For example, the surrounding walls are optionally metallized and reflect or absorb more than 90% of aforesaid electromagnetic radiation incident thereupon in use.

In an example of an embodiment of the present disclosure, a product pouch arrangement is provided that protects one or more products included therein from physical damage when handled, characterized in that:

(i) the product pouch arrangement includes at least a first compartment;
(ii) the at least first compartment in use includes a plurality of shock cushioning elements that cushion the one or more products included in the product pouch arrangement;
(iv) the at least first compartment is sealed so that the plurality of cushioning elements are user-inaccessible (namely sealed, devoid of any user-accessible resalable zip arrangement or similar); and
(v) the at least first compartment has surrounding walls that are fabricated from at least one flexible plastics material.

Optionally, the at least first compartment has surrounding walls that are fabricated from at least one flexible plastics material that transmits electromagnetic radiation in a wavelength range to which a human eye responds but attenuates radiation in an ultra violet (UV) electromagnetic wavelength range. Optionally, in such an example, the at least one flexible plastics material of the surrounding walls can, for example, be opaque or substantially non-transmissive to optical radiation in a human eye response range of 780 nm to 400 nm, and also at UV wavelengths in a range of 400 nm to 10 nm. For example, the surrounding walls are optionally metallized and reflect or absorb more than 90% of aforesaid electromagnetic radiation incident thereupon in use.

In an example embodiment of the present disclosure, a product pouch arrangement protects one or more products included therein from physical damage when handled, characterized in that:

(i) the product pouch arrangement includes at least a first compartment;

(ii) the at least first compartment in use includes a plurality of shock cushioning elements that cushion the one or more products included in the product pouch arrangement;

(iv) the at least first compartment is sealed so that the plurality of cushioning elements are user-inaccessible; and (v) the at least first compartment has surrounding walls that are fabricated from at least one flexible plastics material.

Optionally, the product pouch arrangement only includes one compartment.

In an example embodiment of the present disclosure, a product pouch arrangement protects one or more products included therein from physical damage when handled, characterized in that:

(i) the product pouch arrangement includes at least a first compartment and a second compartment;

(ii) the first compartment in use includes a plurality of shock cushioning elements that cushion the one or more products, wherein the plurality of shock cushioning elements have formed thereonto one or more holographic images or micro-embossed images as an anti-counterfeiting feature;

(iii) the second compartment accommodates in use the one or more products;

(iv) at least one of the first and second compartments are resealable so that the one or more products and/or the plurality of cushioning elements are user-accessible; and (v) the first and second compartments have surrounding walls that are fabricated from at least one flexible plastics material.

Optionally, the micro-embossed images are formed to cooperate with micro-embossed features formed into the surrounding walls of the first and/or second compartment, to form Moiré-fringes that are discernible by a naked human eye.

In an example embodiment of the present disclosure, a product pouch arrangement protects one or more products included therein from physical damage when handled, characterized in that:

(i) the product pouch arrangement includes at least a first compartment and a second compartment;

(ii) the first compartment in use includes a plurality of shock cushioning elements that cushion the one or more products;

(iii) the second compartment accommodates in use the one or more products;

(iv) at least one of the first and second compartments are resealable so that the one or more products and/or the plurality of cushioning elements are user-accessible; and (v) the first and second compartments have surrounding walls that are fabricated from at least one flexible plastics material, wherein the surrounding walls of the first and second compartment are thermally welded along at least a part of their peripheral edges.

In an example embodiment of the present disclosure, a product pouch arrangement protects one or more products included therein from physical damage when handled, characterized in that:

(i) the product pouch arrangement includes at least a first compartment and a second compartment;

(ii) the first compartment in use includes a plurality of shock cushioning elements that cushion the one or more products;

(iii) the second compartment accommodates in use the one or more products;

(iv) the first compartment including the plurality of shock cushioning elements has a wall separating the first compartment from the second compartment that supports gaseous communication between the compartments, wherein the first compartment includes a volatile aromatic substance or preserving agent substance that gaseously diffuses to the second compartment to perfume the one or more products and/or to assist in preservation of the one or more products; and (iv) the first and second compartments have surrounding walls that are fabricated from at least one flexible plastics material.

Optionally, at least one of the first and second compartments are resealable so that the one or more products and/or the plurality of cushioning elements are user-accessible. Optionally, at least one of the first and second compartments are non-resealable.

DETAILED DESCRIPTION OF DRAWINGS

Referring to FIG. 1, illustrated is a front view of a product pouch arrangement 100, in accordance with an embodiment of the present disclosure. Notably, the product pouch arrangement 100 comprises a first compartment and a second compartment (not shown). Furthermore, the at least one of the first and second compartments included in the product pouch arrangement 100 is user-accessible via a zip-sealing arrangement 102 implemented using mutually interlocking mutually parallel elongate ridges formed from a flexible plastics material. Moreover, the peripheral edge, such as the peripheral edge 104 of the product pouch arrangement 100 have a metallic glossy texture. Moreover, the product pouch arrangement 100 includes a tearable seal (not shown) that is user-rippable when initially accessing at least one of the first and second compartments. Furthermore, the product pouch arrangement 100 includes a notch 106 at a point where the tearable seal (not shown) contacts the peripheral edge 104 of the product pouch arrangement 100. Consequently, the user may use the notch to initiate ripping of the tearable seal therefrom, wherein the notch causes a spatial concentration of ripping force in operation.

Figure 2:
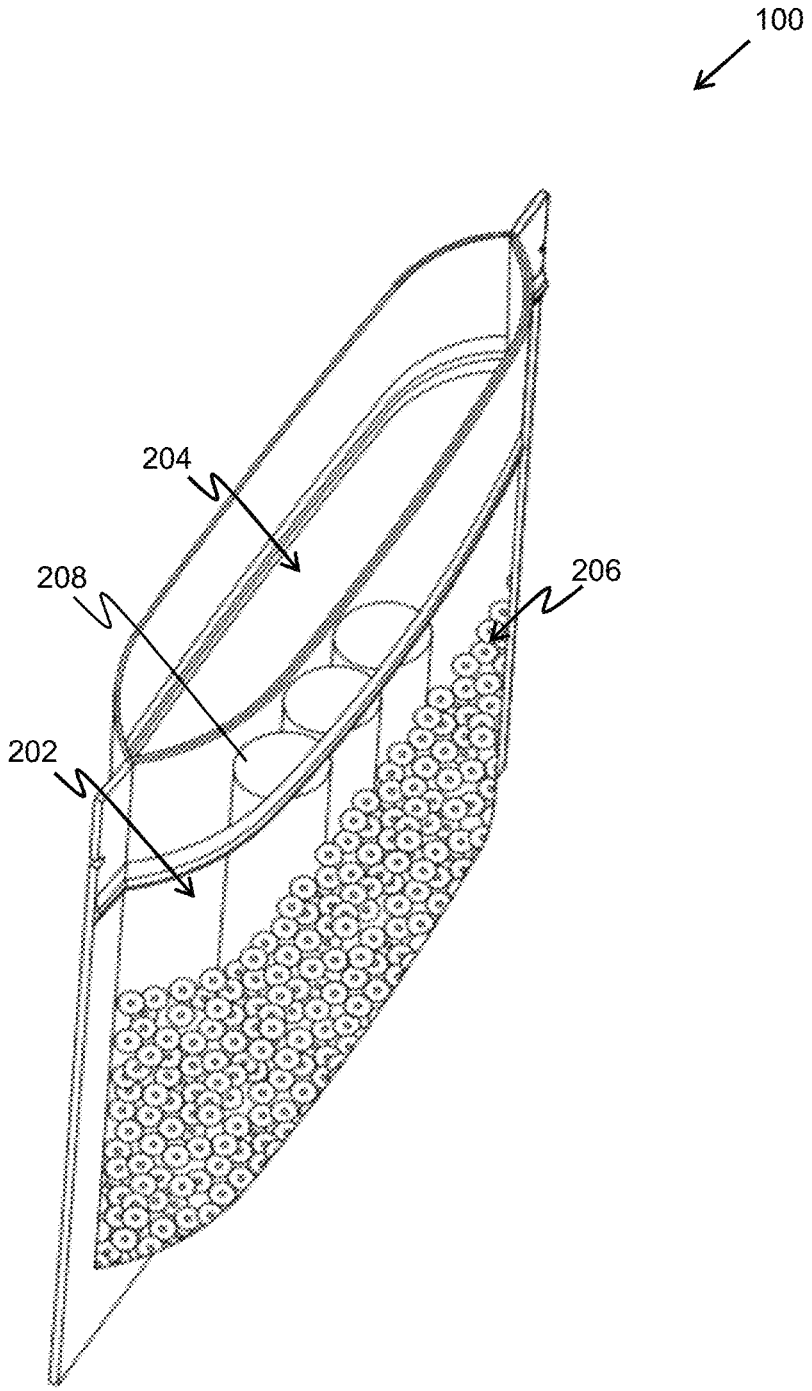
FIG. 2 is an illustration of a perspective view of the product pouch arrangement in a used state, in accordance with an embodiment of the present disclosure.

Referring to FIG. 2, illustrated is a perspective view of the product pouch arrangement 100 in a used state, in accordance with an embodiment of the present disclosure. As shown, the product pouch arrangement 100 comprises a first compartment 202 and a second compartment 204. Furthermore, the first compartment 202 includes a plurality of shock cushioning elements 206. Additionally, the one or more products, such as the product 208 is accommodated in the second compartment 204. Furthermore, the plurality of shock cushioning elements 206 cushion the one or more products 208 thereby preventing it from any physical damage. Moreover, the plurality of shock cushioning elements 206 optically protect the one or more products, such as the product 208. As shown, the plurality of shock cushioning elements 206 are implemented as planar discs, wherein the planar discs have a peripheral out-of-plane features that absorb shock in operation.

Figure 3:
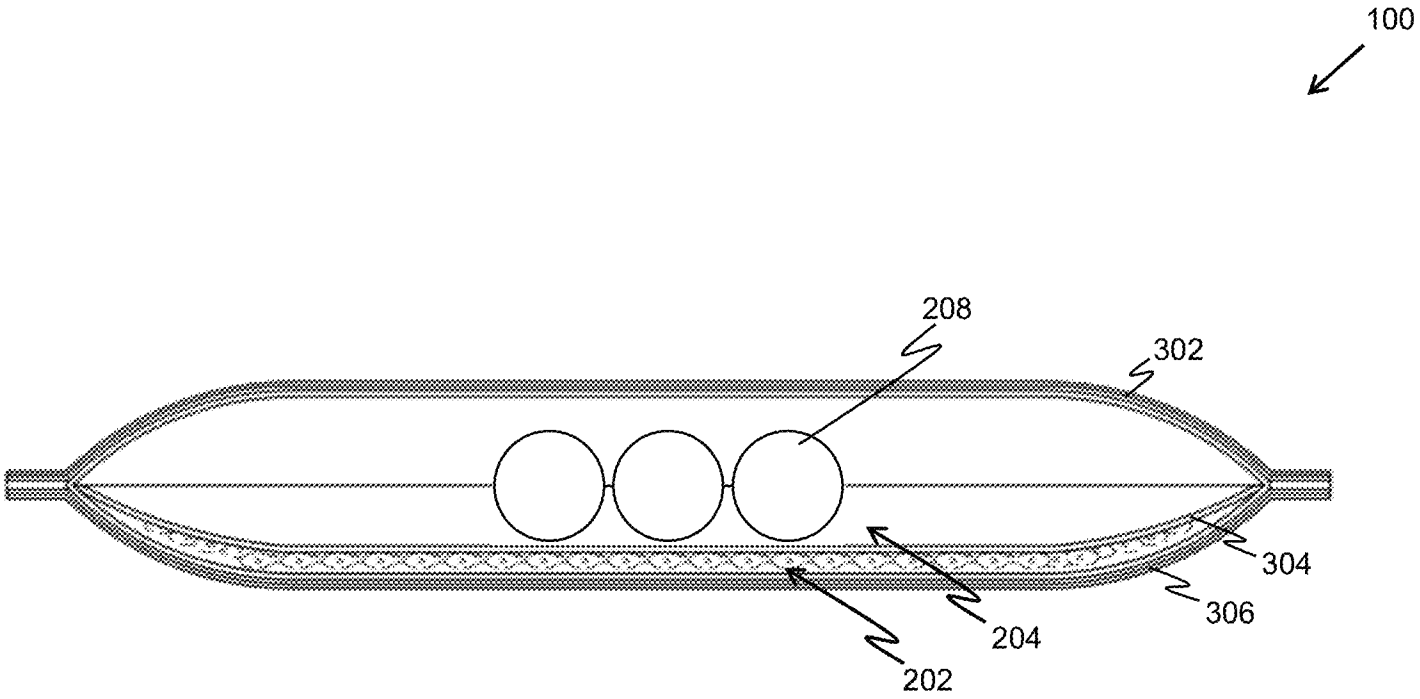
FIG. 3 is an illustration of a top view of the product pouch arrangement in a used state, in accordance with an embodiment of the present disclosure.

Referring to FIG. 3, illustrated is a top view of the product pouch arrangement 100 in a used state, in accordance with an embodiment of the present disclosure. As shown, the first compartment 202 and the second compartment 204 are separated by a surrounding wall 304. The second compartment 204 is substantially filled of more then ca 50%, preferrably more then ca 75% filled, and most preferrably more than ca 90% filled with shock cushioning elements 206. Furthermore, the first compartment 202 and the second compartment 204 have surrounding walls 302 and 306 that are fabricated from at least one flexible plastics material. Typically, the walls 302 to 306 are thermally welded along at least a part of their peripheral edges. Furthermore, the wall 304 is optionally provided with an array of diffusion holes (not shown) that supports gaseous communication between the first compartment 202 and the second compartment 204. Optionally, the shock cushioning elements 206 can also be provided with a sensor to control the pouch 100 environment that could affect the product 208 use by date or changing colour if environment is not appropriate for use with cosmetics or other products. Optionally, the shock cushioning elements 206 can be colour matched to the pouch 100 to allow verification of the authenticity of the overall item and more specifically the product 208.

Figure 4:
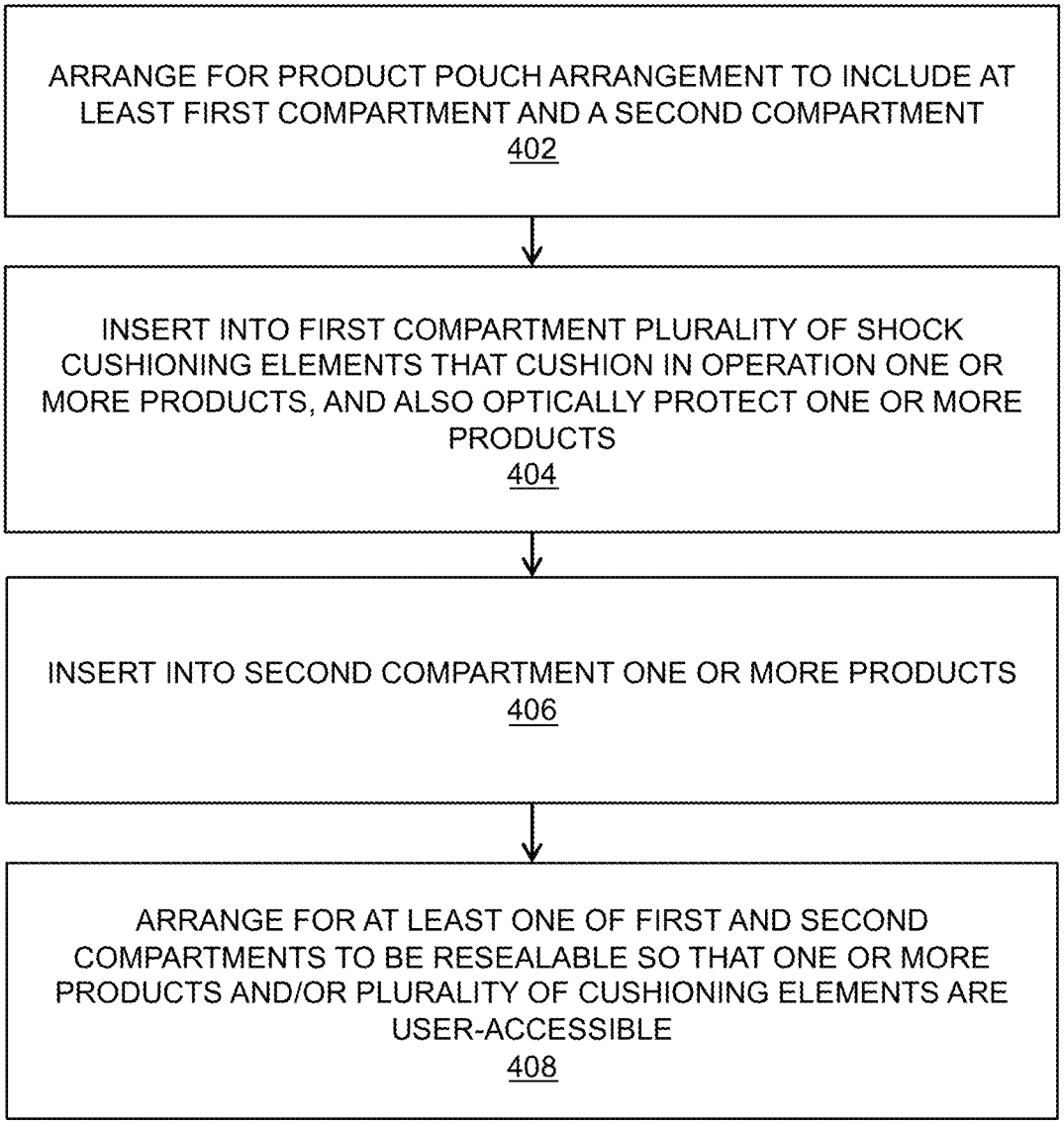
FIG. 4 is an illustration of steps of a method of (for) manufacturing a product pouch arrangement, in accordance with an embodiment of the present disclosure.

Referring to FIG. 4, illustrated are steps of a method 400 of (for) manufacturing a product pouch arrangement, in accordance with an embodiment of the present disclosure. The product pouch arrangement protects in operation one or more products included therein from physical damage when handled. At a step 402, the product pouch arrangement is arranged to include at least a first compartment and a second compartment. The first and second compartments have surrounding walls that are fabricated from at least one flexible plastics material that transmits electromagnetic radiation in a wavelength range to which a human eye responds but attenuates radiation in an ultra violet (UV) electromagnetic wavelength range; UV radiation has an electromagnetic wavelength in a range of 10 nm to 400 nm. At a step 404, a plurality of shock cushioning elements that cushion in operation the one or more products are inserted in the first compartment. Additionally, the plurality of shock cushioning elements also protect the one or more products optically. At a step 406, the one or more products are inserted into the second compartment. At a step 408, at least one of the first and the second compartments is arranged to be resealable so that the one or more products and/or the plurality of cushioning elements are user-accessible.

The steps 402 to 408 are only illustrative and other alternatives can also be provided where one or more steps are added, one or more steps are removed, or one or more steps are provided in a different sequence without departing from the scope of the claims herein. Optionally, the method 400 includes implementing the plurality of shock cushioning elements as planar discs, wherein the planar discs have peripheral out-of-plane features that absorb shock in operation. Optionally, the method 400 includes thermally welding the surrounding walls of the first and second compartment along at least a part of their peripheral edges. Optionally, the method 400 includes arranging for at least one of the compartments to be user-accessible via a zip-sealing arrangement implemented using mutually interlocking mutually parallel elongate ridges formed from a flexible plastics material. Optionally, the method 400 includes forming onto the plurality of shock cushioning elements one or more holographic images or micro-embossed images as an anti-counterfeiting feature. Optionally, the micro-embossed images are formed to cooperate with micro-embossed features formed into the surrounding walls of the first and/or second compartment, to form Moiré-fringes that are discernible by a naked human eye. Optionally, the method 400 includes fabricating the plurality of shock cushioning elements from a plastics material or metal sheet having an optically reflecting planar surface. Optionally, the method 400 includes arranging for the first compartment to include the plurality of shock cushioning elements having a wall separating the first compartment from the second compartment that supports gaseous communication between the compartments, wherein the first compartment includes a volatile aromatic substance or preserving agent substance that gaseously diffuses to the second compartment to perfume the one or more products and/or to assist in preservation of the one or more products.

Optionally, the method 400 includes providing the wall separating the first compartment from the second compartment with an array of diffusion holes that support gaseous diffusion from the first compart to the second compartment with a diffusion time constant (1/e, wherein e=2.71, corresponding to circa 30%) of greater than 24 hours at 20° C.; optionally, the time constant is in a range of 1 day to 365 days, more optionally in a range of 1 day to 180 days. Optionally, the method 400 includes arranging for the product pouch arrangement to include a tearable seal that is user-rippable when initially accessing at least one of the first and second compartments. Optionally, the method 400 includes providing the walls of the first compartment with an adhesive arrangement for maintaining a portion of the shock cushioning elements in a fixed spatial relation to the walls of the first compartment by being adhesively attached thereto. Optionally, the method 400 includes arranging for the at least one flexible plastics material to include at least one of: low-density polyethylene, high-density polyethylene, polypropylene, polyethylene terephthalate, polyvinyl chloride. Optionally, the method 400 includes arranging for the product pouch arrangement to include an opening on a peripheral edge thereof, wherein the opening enables access to at least one of the first and/or second compartments. Optionally, the method 400 includes arranging for the peripheral edges of the product pouch arrangement to have a metallic glossy texture. Optionally, the method is usable for manufacturing a product pouch arrangement.

Figure 5:
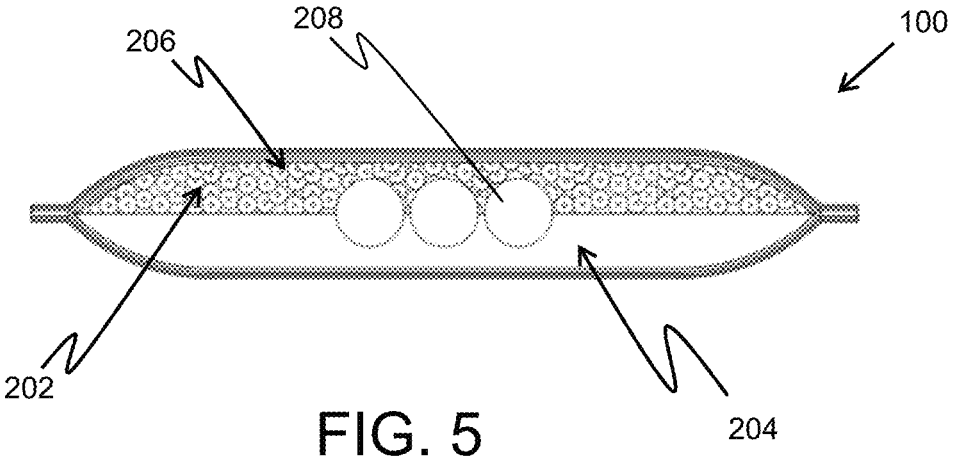
FIG. 5 an illustration of a top view of a product pouch arrangement in a used state, in accordance with an embodiment of the present disclosure.

Referring to FIG. 5, illustrated is a top view of the product pouch arrangement 100 in a used state, in accordance with an embodiment of the present disclosure where the first compartment 202 is sealed by walls 304 and 306 enclosing the shock cushioning elements 206 so that they are not in contact with the product 208. This makes the shock cushioning elements 206 tamper proof preventing counterfeiting unless the walls 304 and/or 306 are tampered with.

Figure 6:
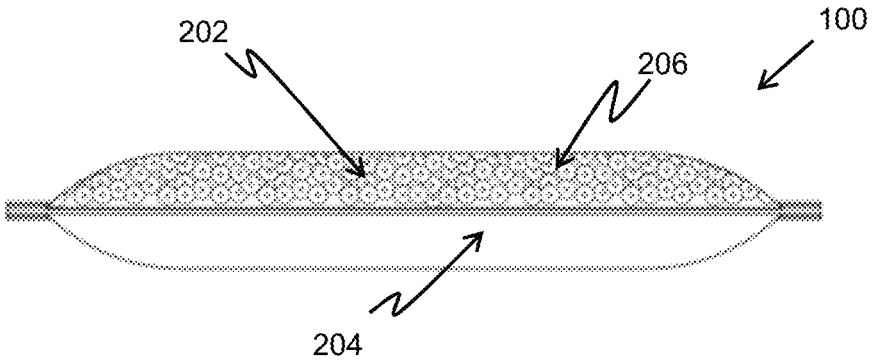
FIG. 6 an illustration of a top view of a product pouch arrangement in a closed state, in accordance with an embodiment of the present disclosure.

Referring to FIG. 6, illustrated is a top view of the product pouch arrangement 100 in a sealed state, in accordance with an embodiment of the present disclosure where the first compartment 202 and second compartment 204 are closed bye e.g. a zip-sealing arrangement 102.

Figure 7:
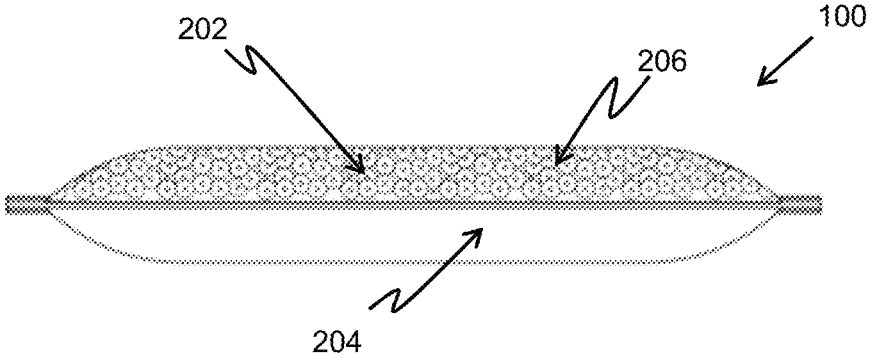
FIG. 7 an illustration of a bottom view of a product pouch arrangement, in accordance with an embodiment of the present disclosure.

Referring to FIG. 7, illustrated is a bottom view of the product pouch arrangement 100 in a used state, in accordance with an embodiment of the present disclosure.

The present invention is included in the general business context, which aims to reduce the material waste due to the shock cushioning elements being contained in a smaller, separate compartment rather than requiring to fill the whole pouch. In particular, the manufacturing of the product pouches is much more cost-efficient and results in a smaller amount of material required to retain the same protective benefits as the comparable packaging. Overall environmental benefits can also be significant when the cushioning elements are manufactured from the waste material remaining after manufacturing of the pouch itself. This will reduce the carbon footprint with lower CO2 emissions as lower weight and less plastic material usage.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method of (for) manufacturing a product pouch arrangement that protects one or more products included therein from physical damage when handled, wherein the method includes:

(i) arranging for the product pouch arrangement to include at least a first compartment and a second compartment, wherein the first and second compartments have surrounding walls that are fabricated from at least one flexible plastics material that transmits electromagnetic radiation in a wavelength range to which a human eye responds but attenuates radiation in an ultra violet (UV) electromagnetic wavelength range;

(ii) inserting into the first compartment a plurality of shock cushioning elements that cushion in operation the one or more products, and also optically protect the one or more products;

(iii) inserting into the second compartment the one or more products; and (iv) arranging for at least one of the first and second compartments to be resealable so that the one or more products and/or the plurality of cushioning elements are user-accessible, wherein the method includes forming onto the plurality of shock cushioning elements one or more holographic images or micro-embossed images as an anti-counterfeiting feature, and wherein the micro-embossed images are formed to cooperate with micro-embossed features formed into the surrounding walls of the first and/or second compartment, to form Moiré-fringes that are discernible by a naked human eye.

2. The method of claim 1, wherein the method includes implementing the plurality of shock cushioning elements as planar discs, wherein the planar discs have peripheral out-of-plane features that absorb shock in operation.

3. The method of claim 1, wherein the method includes thermally welding the surrounding walls of the first and second compartment along at least a part of their peripheral edges.

4. The method of claim 1, wherein the method includes arranging for at least one of the compartments to be user-accessible via a zip-sealing arrangement implemented using mutually interlocking mutually parallel elongate ridges formed from a flexible plastics material.

5. The method of claim 1, wherein the method includes fabricating the plurality of shock cushioning elements from a plastics material or metal sheet having an optically reflecting planar surface.

6. The method of claim 1, wherein the method includes arranging for the first compartment to include the plurality of shock cushioning elements having a wall separating the first compartment from the second compartment that supports gaseous communication between the compartments, wherein the first compartment includes a volatile aromatic substance or preserving agent substance that gaseously diffuses to the second compartment to perfume the one or more products and/or to assist in preservation of the one or more products.

7. The method of claim 6, wherein the method includes providing the wall separating the first compartment from the second compartment with an array of diffusion holes that support gaseous diffusion from the first compartment to the second compartment with a diffusion time constant (1/e) of greater than 24 hours at 20° C.

* * * * *